US005878545A

United States Patent [19]

Gebhart

[11] Patent Number: 5,878,545

[45] Date of Patent: Mar. 9, 1999

[54] BLOCK, IN PARTICULAR SHUTTERING BLOCK OR STANDARD BLOCK

[76] Inventor: Siegfried Gebhart, Tobelstadel, D-88319, Aitrach, Germany

[21] Appl. No.: 794,246

[22] Filed: Feb. 3, 1997

[30] Foreign Application Priority Data

Feb. 3, 1996 [DE] Germany ..... 29601827 U

[51] Int. Cl.[6] ..... E04B 5/04

[52] U.S. Cl. ..... 52/598; 52/596; 52/309.11

[58] Field of Search ..... 52/309.7, 309.11, 52/612, 598, 601, 604.607, 309.1, 309.5; 405/284–286

[56] References Cited

U.S. PATENT DOCUMENTS

| | | | |
|---|---|---|---|
| 4,478,021 | 10/1984 | Person | 52/612 X |
| 4,641,470 | 2/1987 | Baumberger | 52/612 X |
| 4,854,097 | 8/1989 | Haener | 52/612 X |
| 5,321,926 | 6/1994 | Kennedy | 52/612 X |
| 5,350,256 | 9/1994 | Hammer | 52/612 X |
| 5,465,542 | 11/1995 | Terry | 52/309.7 |
| 5,509,245 | 4/1996 | Gebhart | 52/309.11 X |

FOREIGN PATENT DOCUMENTS

| | | | |
|---|---|---|---|
| 2 536 777 | 6/1984 | France . | |
| 2525539 | 12/1976 | Germany | 52/612 |

*Primary Examiner*—Beth A. Aubrey
*Attorney, Agent, or Firm*—Welsh & Katz, Ltd.

[57] ABSTRACT

A block, in particular a shuttering block or standard block, has two longitudinal walls which form an outer wall and an inner wall. These are connected to one another by at least one transverse wall, which extends over at least part of the height of the block. The outer wall is produced from an insulating material and is connected to the inner wall via positively locking connecting devices. In this arrangement, the at least one transverse wall is integral with the outer wall.

9 Claims, 1 Drawing Sheet

BLOCK, IN PARTICULAR SHUTTERING BLOCK OR STANDARD BLOCK

FIELD OF THE INVENTION

The invention relates to a block, in particular shuttering block or standard block, having two longitudinal walls which form an outer wall and an inner wall and are connected to one another by at least one transverse wall, which extends over at least part of the height of the block, the outer wall being produced from an insulating material and being connected to the inner wall via positively locking connecting devices.

BACKGROUND OF THE INVENTION

A block of the generic type is known from FR-A-2 536 777.

In the case of the known block, the inner wall and the transverse walls are produced from concrete or a concrete-like material, those ends of the transverse walls which face the outer wall of the block being provided with T-shaped extensions, and it being possible in each case for the horizontal bar on the "T" to be inserted into complementary recesses in the outer wall, which is produced from an insulating material.

The disadvantage with the known shuttering block, however, is that it allows only comparatively poor sound insulation and heat insulation, which is not sufficiently in keeping with modern environmental awareness, in particular as regards the saving of energy.

The object of the present invention is thus to provide a block, in particular shuttering block or standard block, which allows improved sound insulation and heat insulation in comparison with the prior art.

This object is achieved according to the invention in that the at least one transverse wall is integral with the outer wall.

SUMMARY OF THE INVENTION

The novel design of the block achieves substantially better and more effective insulation in comparison with the prior art since those regions of the block which are normally cold bridges, namely the transverse walls, are now also produced entirely from an insulating material and, as a result, substantially improved insulating properties can be achieved in comparison with known blocks.

Furthermore, the assembly of the novel block is very straightforward since it comprises only two parts, namely the inner wall, which is produced from concrete or a concrete-like material or expanded clay, and the single-piece combination of at least one transverse wall and the outer wall, said combination being produced from an insulating material.

In an advantageous configuration of the invention, it may be provided that the at least one transverse wall has at least one cavity running in the vertical direction, transversely to the longitudinal direction of the block.

The at least one cavity allows elastic deformation of the transverse walls, which is advantageous, in particular, if the novel block is designed as a shuttering block, since, once concrete has been introduced, the transverse walls are compressed elastically in a region between the longitudinal walls as the concrete sets, it being possible for shrinkage stresses to be absorbed by the transverse walls, thus preventing cracks and fractures in the transverse walls. By the provision of at least one cavity and the resulting deformation properties of the at least one transverse wall, the concrete thus has sufficient space to expand without damaging or destroying other components or parts of the block as a result.

These cavities are normally too narrow for any concrete to be able to flow into them as the block is being filled.

However, in an advantageous configuration of the invention, the cavities cannot be continuous from top to bottom of the block; rather, they can be open merely on the underside of the block and extend to just beneath the upper side of the respective transverse wall, as a result of which concrete is prevented from flowing into the cavities and the abovedescribed advantageous deformation properties of the at least one transverse wall are not adversely affected.

Dovetail-shaped recesses may be provided on the outer side of the outer wall of the block for the purpose of retaining a basecoat plaster which is to be applied to the outer wall.

Once it has set, the basecoat plaster is retained very well in these recesses, so that there are no problems as regards insufficient adherence of the basecoat plaster on the insulating material of the outer wall; rather, since it is retained in a positively locking as well as a frictionally locking manner, this basecoat plaster is retained on a wide variety of outer-wall materials.

In order to permit a simple processing of the novel blocks on the building site, positively locking connecting devices, which are provided with undercuts, may be provided at the ends of at least one of the longitudinal walls of each block for the purpose of connecting a plurality of blocks arranged one beside the other.

The individual blocks can thus be easily connected to one another in a positively locking manner just like a modular system.

Furthermore, it may also be provided that groove and tongue connections are provided in each case on the upper side and underside of at least one of the longitudinal walls for the purpose of connecting a plurality of blocks arranged one above the other, the tongue connections being of wedge-shaped design or being provided with bevels.

The operation of positioning novel blocks one upon the other in a positively locking manner is simplified considerably by the provision of wedge-shaped or bevel-containing groove and tongue connections since the abovedescribed configuration of the groove and tongue connections provides an introduction and centring aid which speeds up considerably the operation of positioning a plurality of blocks one upon the other.

Polystyrene, in particular PS 30, may be provided as the insulating material for the outer wall and the at least one transverse wall, which is integral with the outer wall, but it is also possible, of course, to provide, for example, cork or another suitable insulating material for the outer wall. The selection of a suitable material in this case is at the discretion of the person skilled in the art.

The positively locking connecting devices may easily have a dovetail-shaped or T-shaped cross section, but basically any cross section which has an undercut is suitable for the purpose of connecting the two components of the novel block.

Straightforward assembly of the novel block is possible, in particular, when the positively locking connecting devices extend in the vertical direction, so that it is easily possible, for example, for the inner wall to be pushed onto the at least one transverse wall from above.

BRIEF DESCRIPTION OF THE FIGURES

An exemplary embodiment of the present invention is described in principle hereinbelow with reference to the drawing, in which.

DETAILED DESCRIPTION OF THE PREFERRED EMBODIMENTS

Figure 1:
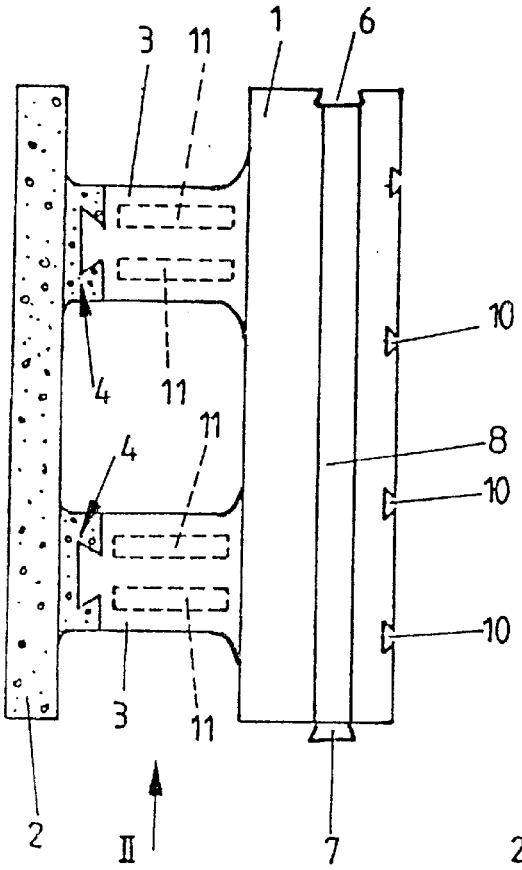
FIG. 1 shows a plan view of a novel block.
Figure 2:
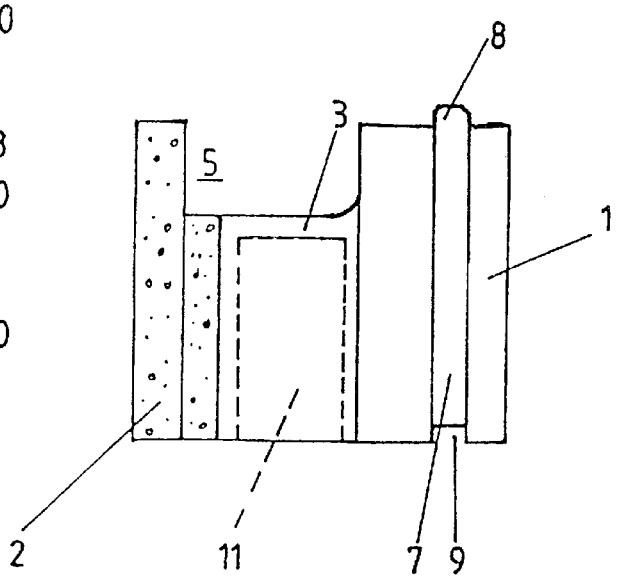
FIG. 2 shows a side view of the block in the direction of the arrow II of FIG. 1.

With reference to FIGS. 1 and 2, the block illustrated, which is designed as a shuttering block, has two longitudinal walls which form an outer wall 1 and an inner wall 2. The two longitudinal walls 1 and 2 are connected to one another at right angles by two transverse walls 3, which are produced integrally with the outer wall 1.

In relation to the lateral ends (ends of the outer wall 1 and inner wall 2), the transverse walls 3 are each offset inwards to some extent, with the result that the block illustrated is at least approximately in the form of an "H".

The two transverse walls 3 are connected, on their underside, flush with the underside of the block and extend up to a height of approximately 180 mm.

The inner wall 2 is produced from concrete or a concrete-like material or expanded clay, while the outer wall 1 and the transverse walls 3, which are integral with the outer wall 1, are produced from polystyrene, that is to say from an insulating material.

The inner wall 2 is connected to the transverse walls 3 or the outer wall 1 via positively locking connecting devices 4 (see FIG. 1), which are of dovetail-shaped design in the present exemplary embodiment, but may also be of some other suitable geometrical shape.

Since the transverse walls 3 of the block illustrated do not extend as far as the upper side of the block, clearances 5 (see FIG. 2) are provided above the transverse walls 3, and these are used for the subsequent filling of concrete horizontally in the longitudinal direction of the block.

Connecting devices designed in each case as an indent 6 and a protrusion 7 which is complementary thereto are arranged at the ends of the outer wall 1, each indent 6 or protrusion 7 being provided with undercuts and being designed such that the protrusion 7 of one block engages in an indent 6 of an adjacent block, this providing a positively locking connection between adjacent blocks and allowing the blocks to be easily lined up in rows one beside the other in modular fashion.

Groove and tongue connections are provided on the upper side and underside of the outer wall 1, these connections each having a tongue 8 or a ridge and a groove 9 which are located one above the other and run parallel to one another. In this arrangement, the tongue 8 is provided with bevels, which render the operation of stacking blocks one above the other, and thus of building walls, considerably easier since the bevels serve as introduction and centring aids as the blocks are positioned one upon the other.

Dovetail-shaped recesses 10 are provided on the outer side of the outer wall 1 and serve for retaining a basecoat plaster (not illustrated), i.e. the basecoat plaster penetrates into the dovetail-shaped recesses 10 and sets therein, as a result of which a positively locking connection is produced between the outer wall 1 and the basecoat plaster.

The already mentioned positively locking connecting devices 4, which serve for connecting the transverse walls 3 to the inner wall 2, run at least approximately vertically, with the result that the block illustrated is assembled simply by pushing the outer wall 1, with the transverse walls 3, onto the inner wall 2.

If that region of the block which is located between the longitudinal walls 1 and 2 is subsequently filled with concrete, then a stable and strong unit is produced, separation of the connection between the transverse walls 3 and the inner wall 2, which is undesirable, being virtually impossible.

The transverse walls 3 have cavities 11 which run in the vertical direction, are in the form of slits and allow elastic deformation of the transverse walls 3 in the longitudinal direction of the block.

This elastic deformation takes place in the region between the longitudinal walls 1, 2 as the concrete sets. Due to the "swelling up" of the concrete during setting, the transverse walls 3 are moved into an elastically stretched position, thus avoiding cracks in the insulating material due to the occurrence of shrinkage stresses.

In this arrangement, the cavities 11 are not continuous from the upper side to the underside of the transverse walls 3; rather, they are open merely on the underside in order to avoid concrete flowing into the cavity 11 as the shuttering block is being filled and to achieve the abovedescribed deformation properties of the transverse walls 3.

The cavities 11 thus extend from the underside of the transverse walls 3 to just beneath the upper side thereof.

The abovedescribed block and its possible embodiment illustrated in the figures comply with all the regulations for sound and heat insulation and can thus be used universally. In particular, the stability of the block is high enough to allow even multi-storey buildings and load-bearing walls to be built using blocks of this type.

What is claimed is:

1. A load bearing block for use in construction, the block comprising an outer insulating wall having an inner surface and an outer surface opposite the inner surface, the inner surface having a height, and an inner load bearing wall having an inner surface having a height, the height of the inner surface of the inner wall being the same as the height of the inner surface of the outer wall, the inner wall and the outer wall connected by at least one transverse wall, the transverse wall extending over at least a part of the height of the walls, the outer wall and the transverse wall being formed of an insulating material, the inner wall being connected to the transverse wall via a positively locking connecting device, whereby the at least one transverse wall and first positively locking connecting device do not extend into the outer wall.

2. The block as claimed in claim 1, wherein the at least one transverse wall has formed therein at least one cavity extending transverse to a longitudinal direction of the block.

3. The block as claimed in claim 2, wherein each cavity extends from an underside of the block to just beaneath an upper side of the transverse wall.

4. The block as claimed in claim 1, wherein dove-tail-shaped recesses are provided on the outer surface of the outer wall for retaining a basecoat plaster applied to the outer surface of the outer wall.

5. The block as claimed in claimed 1, including a second positively locking connecting device formed with undercuts, the second connecting device being formed at ends of the outer wall for connecting a plurality of blocks arranged one beside the other.

6. The block as claimed in claim 1, including complementary groove and tongue connections formed in an upper side and an underside of the outer wall for connecting a plurality of blocks arranged one above the other.

7. The block as claimed in claim 1, wherein the outer wall and the at least one transverse wall are produced from polystyrene.

8. The block as claim in claim 5, wherein at least one of the first and second positively locking connecting devices have a cross-section selected from the group consisting of dove-tail-shaped and T-shaped.

9. The block as claimed in claim 8, wherein the positively locking connecting devices extend substantially parallel to the walls.

* * * * *